US006826126B2

(12) United States Patent
Wyssbrod

(10) Patent No.: US 6,826,126 B2
(45) Date of Patent: Nov. 30, 2004

(54) STACKED ASSEMBLY OF A PLURALITY OF MODULES FORMING AN ELECTRONIC OR ELECTROMECHANICAL DEVICE, IN PARTICULAR FOR AN ULTRA-THIN TIMEPIECE

(75) Inventor: Baptist Wyssbrod, Bienne (CH)

(73) Assignee: Eta SA Fabriques d'Ebauches (CH)

( * ) Notice: Subject to any disclaimer, the term of this patent is extended or adjusted under 35 U.S.C. 154(b) by 361 days.

(21) Appl. No.: 09/996,639

(22) Filed: Nov. 27, 2001

(65) Prior Publication Data

US 2002/0064097 A1 May 30, 2002

(30) Foreign Application Priority Data

Nov. 29, 2000 (CH) ..... 2325/00

(51) Int. Cl.[7] ..... G04B 37/04

(52) U.S. Cl. ..... 368/88; 368/297; 368/287

(58) Field of Search ..... 368/88, 276, 280, 368/297–299, 300, 309, 310, 316, 317, 287

(56) References Cited

U.S. PATENT DOCUMENTS

| | | | | |
|---|---|---|---|---|
| 4,198,809 A | | 4/1980 | Miyasaka et al. | |
| 4,351,040 A | | 9/1982 | Aoki | |
| 4,367,956 A | * | 1/1983 | Windstey | 368/88 |
| 4,996,676 A | * | 2/1991 | Noirjean | 368/73 |
| 5,220,541 A | * | 6/1993 | Vuilleumier | 368/88 |
| 5,245,580 A | | 9/1993 | Ferenczy | |
| 6,575,619 B1 | * | 6/2003 | Stauffer | 368/299 |

FOREIGN PATENT DOCUMENTS

EP 0 907 116 A1 7/1999

* cited by examiner

*Primary Examiner*—Randy W. Gibson
*Assistant Examiner*—Jeanne-Marguerite Goodwin
(74) *Attorney, Agent, or Firm*—Richard K. Robinson

(57) ABSTRACT

There is described a stacked assembly of a plurality of modules (32, 33, 36) and a timepiece (1) including such an assembly forming a movement (3). The modules are mounted via assembly orifices on a plurality of mounting pins (24) and assembled by compression between first and second planes (23, 25). In order to absorb variations in thickness (e) in a first element (34) of the assembly, the latter includes a plurality of tube-shaped intermediate elements, called stepped tubes (8), mounted respectively on the mounting pins, each stepped tube being inserted in an assembly orifice (34*a*) of the first element. Each stepped tube (8) has:

first and second reference surfaces (81, 82) separated by a determined distance (d1) greater than the thickness (e) of said first element (34) and against which the assembly is supported, and a zone (85), between said first and second reference surfaces (81, 82) allowing said first element (34) to be kept in abutment in the assembly, the length (d2) of said zone (85), in the direction of said mounting pins (24), being such that it allows variations in the thickness (e) of said first element to be absorbed.

15 Claims, 2 Drawing Sheets

STACKED ASSEMBLY OF A PLURALITY OF MODULES FORMING AN ELECTRONIC OR ELECTROMECHANICAL DEVICE, IN PARTICULAR FOR AN ULTRA-THIN TIMEPIECE

TECHNICAL FIELD

The present invention generally relates to a stacked assembly of a plurality of modules forming an electronic or electromechanical device. More particularly, the present invention relates to an ultra-thin timepiece including such an assembly.

BACKGROUND OF THE INVENTION

Stacked assemblies of a plurality of mechanical, electronic and/or electromechanical modules are known to those skilled in the art. Such assemblies are used in particular in the horological field in order to link, in the form of a stack, the different modules forming the movement of a timepiece, such as a plate, an electronic module including in particular a printed circuit board carrying various electronic and electric components of the timepiece, and, where necessary, a support bearing one or more drive means for a motion-work mechanism.

In the horological field, a solution allowing such an assembly to be achieved consists for example in stacking the various modules on mounting pins, then securing everything together, for example by riveting, i.e. by plastically deforming the end of the mounting pins. Such a solution is particularly advantageous since the assembly of the various elements forming the modules can be effected very easily and can in particular be effected automatically or semi-automatically.

Such a stacked module assembly has however a drawback in that the vertical precision of the assembly is dependent on the precision and manufacturing tolerances of the various assembled modules, in particular the thickness of the elements forming the assembly. Although it is relatively easy to manufacture certain components with a determined thickness with low tolerance, such precision and low tolerance cannot be guaranteed for each assembled module. In particular, those skilled in the art encounter great difficulty in manufacturing printed circuit boards of a guaranteed thickness within a reduced range of tolerance. If those skilled in the art wish to manufacture a timepiece incorporating a stacked module assembly as described hereinbefore, wherein at least one module includes an element of widely variable thickness, such as an electronic module including a printed circuit board, they will not be able to guarantee sufficient precision and assembly tolerance for certain applications where such precision is a necessity.

In particular, if those skilled in the art wish to manufacture a timepiece which has to answer certain strict criteria as to precision and assembly tolerance, in particular with a view to manufacturing an ultra-thin timepiece whose thickness is a critical factor, they will not be able to find, in the solutions currently available, a sufficiently satisfactory solution.

SUMMARY OF THE INVENTION

The object of the present invention is thus to propose a stacked assembly of various modules forming an electronic or electromechanical device, such as a timepiece movement, which allows account to be taken of variations in thickness of at least one constituent element of the assembled modules in order to ensure that the assembly has a determined thickness within a reduced tolerance range.

Another object of the present invention is to propose such an assembly which does not however involve any substantial complication of the assembling process and which does not increase the manufacturing costs of the assembled device.

The present invention thus concerns a stacked assembly of a plurality of modules forming an electronic or electromechanical device the features of which are listed in claim 1.

Advantageous embodiments of this assembly form the subject-matter of the dependent claims.

The present invention also concerns an electronic or electromechanical timepiece including such an assembly whose features are listed in claim 5.

Advantageous embodiments of this timepiece form the subject-matter of the dependent claims. Thus, according to a particular aspect of the invention, various modules forming an electromechanical timepiece are assembled in this manner so as to ensure that the thickness of the whole assembly has a high level of precision allowing in particular a determined clearance to be guaranteed as regards the various wheels, such as the third wheel and the intermediate wheel and/or the motion-work wheels of the timepiece movement, such clearance being necessary to allow the movement to work properly. The assembly according to the present invention is used in particular to manufacture an ultra-thin timepiece.

An advantage of the present invention lies in particular in the simplicity of its implementation. Indeed, according to the present invention, an intermediate tube-shaped element, whose outer diameter varies in discrete steps, hereinafter referred to as "stepped tube", is mounted on the mounting pins of the assembly, this stepped tube being inserted in the assembly orifice of the assembled element whose thickness is not guaranteed so as to hold this element in abutment in the assembly. This stepped tube has first and second reference surfaces separated by a determined distance and against which the assembly is supported. In between these two reference surfaces, the intermediate element has a zone which penetrates the element concerned, preferably so as to cause plastic deformation of this element, the length of this zone (in the direction of assembly) being such that it allows the variations in thickness of the element to be absorbed. The two faces of the element whose thickness is not guaranteed thus do not both abut the neighbouring modules so that the thickness of the assembly is not dependent upon the thickness of this element but is determined by the two reference surfaces of the stepped tube.

According to another particular aspect of the present invention, motor coils of the electromechanical timepiece are further advantageously secured by means of the stepped tube.

The solution according to the present invention thus provides a vertical assembly of great precision without this resulting in an increase in the complexity and cost of manufacturing the assembled device.

BRIEF DESCRIPTION OF THE FIGURES

Other features and advantages of the present invention will appear more clearly upon reading the following detailed description, made with reference to the annexed drawings given by way of non limiting examples and in which:

FIG. 1 shows a partial schematic plan view of an electromechanical timepiece, indicated generally by the reference numeral 1, characterised by its very small thickness and incorporating a stacked assembly according to the present invention. For the purposes of illustration, a part of the back cover of timepiece 1 illustrated in FIG. 1 has been omitted to allow a part of the movement of said timepiece to be seen. FIG. 2 shows a cross-section of the timepiece illustrated in FIG. 1 taken along the cross-section line A—A' of the same Figure.

Figure 1:
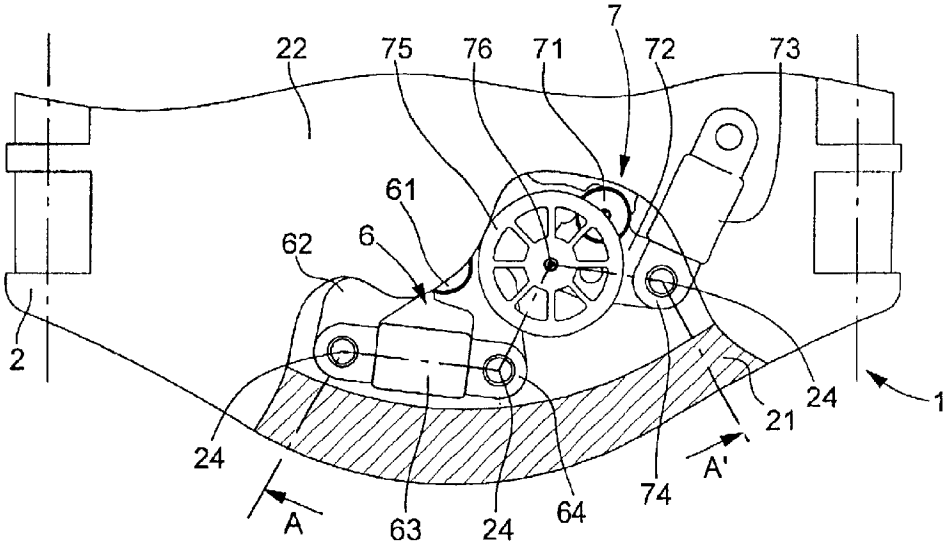
FIG. 1 shows a partial schematic plan view of the back of an electromechanical timepiece incorporating a stacked assembly of modules according to the present invention.

Timepiece 1 illustrated includes in particular a back cover or back cover-middle part 2, preferably made of a plastic material, formed of a middle part 21 and a back cover 22 made in a single piece, a movement 3 formed of a stacked assembly of various modules (the assembly will be described in more detail hereinafter), a dial 4 arranged above movement 3, and a crystal 5.

Figure 2:
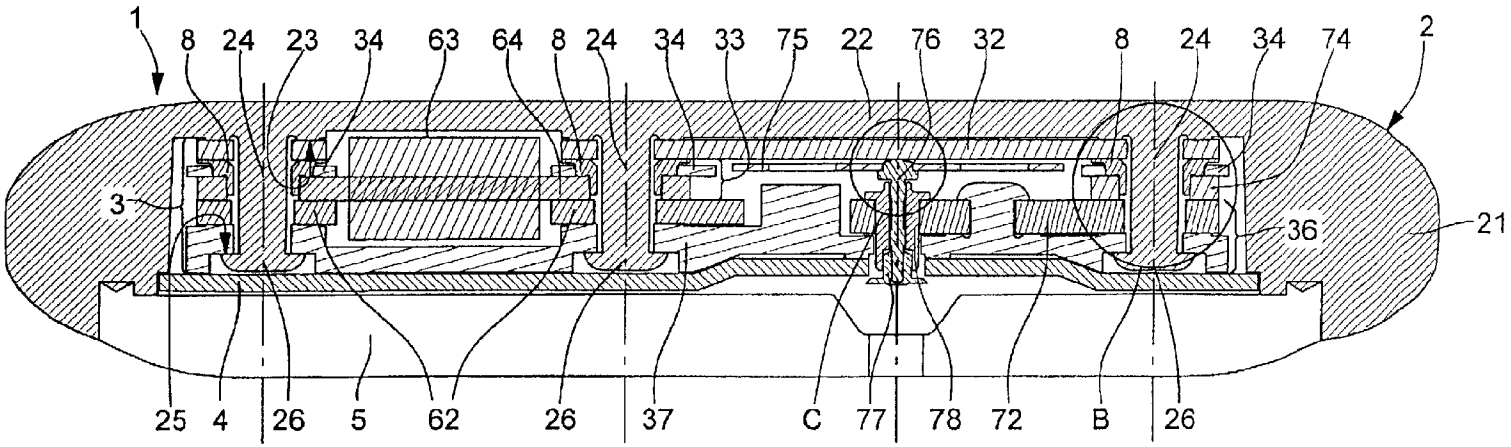
FIG. 2 shows a cross-section of the timepiece taken along the line A—A' of FIG. 1.
Figure 3:
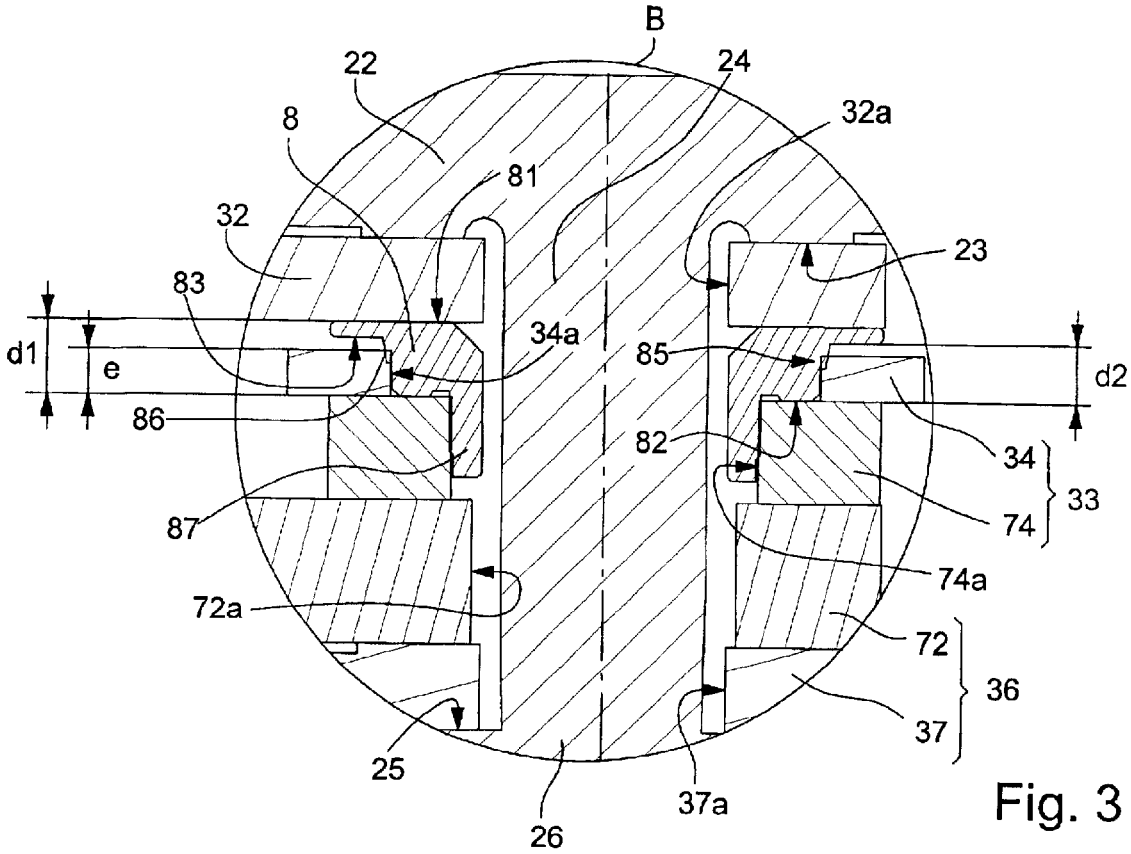
FIG. 3 shows an enlarged cross-section designated B of a mounting pin of the assembly illustrated in FIG. 2 showing the structure of a stepped tube.

FIG. 3, to which reference will also be made where necessary, shows an enlarged view, designated B, of the cross-section of FIG. 2.

The timepiece illustrated in the Figures is the result of developments made by the Applicant with a view to designing an ultra-thin electromechanical timepiece including a case made of plastic material, the timepiece including, in addition to the conventional analogue time display means, analogue display means for a chronometric time. This timepiece is derived, in its philosophy, from a product developed by the Applicant and which first appeared on the market in 1997 under the name of "Swatch SKIN" (registered trademark). By way of information, reference could be made to the article "Swatch SKIN—La montre plastique ultra-plate", by M. O. Koch, published in the Actes of the 64th Congrès de Chronométrie, Société Suisse de Chronométrie, Le Sentier, Sep. 30-Oct. 1st, 1999, Session 1-Produits I, Communication 1, pp. 11 to 14. By way of complementary information, reference could also be made to the European Patent No. 0 691 596 in the name of the Applicant disclosing a wristwatch made of plastic material including a metal reinforcing armature used as a plate, such wristwatch conforming to the aforementioned product.

The "Swatch SKIN" includes only conventional time display means including hour and minute hands and is characterised by a thickness of the order of 4 mm. By way of comparison, the ultra-thin electromechanical timepiece newly developed by the Applicant includes, in addition to the conventional analogue time display means, three other analogue display means for a measured time, namely a first counter for the tenths of a second, a second counter for the seconds, and a third counter for the minutes, and is characterised by a thickness slightly greater than the "Swatch SKIN" of 5.9 mm for a comparable diameter of 37.6 mm. This timepiece is only partially illustrated in the Figures.

EMBODIMENT OF THE INVENTION

It will also be noted that each of the display members of this timepiece is conventionally driven by drive means (four in number here) each including a bipolar motor of the Lavet type formed of a rotor, a stator and a coil mounted on the stator. Not all of the display members and drive means are illustrated in detail in the Figures, since they do not form the subject of the present invention. Nonetheless, a part of these elements is apparent in the Figures.

It should be stressed that the present invention specifically applies to a stacked assembly of a plurality of modules forming in particular the movement of an electronic or electromechanical timepiece. It will be noted that the timepiece illustrated constitutes only one particularly advantageous application example of the present invention. Indeed, given its complexity and strict thickness constraints, it was necessary to develop a vertical assembly of great precision, such assembly forming the subject of the present invention. It will be understood that the invention is in no way limited to this single embodiment and that it may advantageously be applied to any electronic or electromechanical timepiece requiring precise vertical assembling of the various stacked modules. By extension, the present invention may be applied to any electronic or electromechanical device different from a timepiece including a stacked assembly of a plurality of modules which have to answer strict thickness tolerance criteria.

With reference once again to FIGS. 1 and 2, a part of the drive means for the analogue time display means can be seen, including a first bipolar Lavet type motor 6 formed of a rotor 61 (partially shown), a stator 62 and a coil 63 wound on a core 64 which is in contact with stator 62. This first motor drives the analogue display member in a conventional manner via a gear train (not shown).

A part of the analogue display member drive means of one of the three chronometric counters (in this case, and in a non limiting manner, the chronometric minute counter) is also illustrated. These drive means include a second bipolar Lavet type motor 7 formed of a rotor 71 (FIG. 1 only), a stator 72 and a coil 73 wound on a core 74 which is in contact with stator 72. Rotor 71 of this second motor 7 drives in rotation a counter wheel 75 carrying a shaft 76 of counter wheel (FIG. 2) and a counter hand 77 (FIG. 2) indicating, in this case, chronometric information relating to the measured time (for example the minutes).

Two other drive means (not illustrated), similar to the drive means described hereinbefore, are arranged in a similar manner in timepiece 1 in order to drive the analogue display members of the two other chronometric counters (not shown).

With reference more specifically to FIGS. 2 and 3, movement 3, which has already been mentioned, includes an assembly of various stacked modules, namely, starting from back cover 22, a lower plate 32, an electronic module 33, including in particular a printed circuit board 34, and a motor module, generally indicated by reference 36.

The lower plate is for example made of a metal material and is used in particular to reinforce timepiece case 2, case 2 being preferably made of a plastic material.

Electronic module 33 supports, on printed circuit board 34, various electric and electronic components of the timepiece, in particular a quartz (not shown), an integrated circuit (not shown) intended in particular to control the time-related functions of the timepiece and to drive the motors, contact members for connection to a battery (not shown) and coils (coils 63, 73 and other coils which are not illustrated) of the drive means for the display members of the timepiece.

Motor module 36, supports the rotors and stators of the motors (for example rotors 61, 71 and stators 62, 72 of motors 6, 7), and the various wheels and pinions of motion work and chronometric counter (for example counter wheel 75 and the shaft 76 of counter wheel). More specifically, motor module 36 includes an upper plate 37 onto which the stators of the drive means of the analogue display members are riveted as illustrated in FIG. 2.

Lower plate 32, electronic module 33 including its printed circuit board 34, and motor module 36 are stacked in that order on a plurality of mounting feet or pins 24 which are preferably integral with back cover 22 and case 2 and pass through assembly orifices arranged in the various modules. These assembly orifices are respectively designated by the numerical references of the corresponding elements followed by the index a. The reference 34*a* indicates for example an assembly orifice of printed circuit board 34.

Only three mounting pins 24 are illustrated in FIGS. 1 and 2, but it will of course be understood that a suitable number of pins is used to assure the stability of the assembly in the timepiece.

In this embodiment, mounting pins 24 are preferably arranged to pass through not only the various modules 32, 33 and 36, but also orifices arranged at the ends of the cores on which the coils are wound (for example cores 64 and 74 of coils 63 and 73 illustrated in FIGS. 1 and 2). In the Figures, the assembly orifices of the coil cores are also indicated by the references of the corresponding elements followed by the index a. In this embodiment, it will be noted, in a non limiting way, that at least eight mounting pins are provided to keep the four motor coils respectively driving the four analogue display members of the timepiece.

As illustrated in FIG. 2, the various elements follow each other as follows, from back cover 22: lower plate 32, printed circuit board 34 of electronic module 33, the core of a coil (64, 74 or others which are not illustrated), the corresponding stator (62, 72 or others which are not illustrated), and upper plate 37 of motor module 36. It will be understood in particular that the elements are assembled in this way, so that the coil cores are in contact with the corresponding stators of the drive means.

In order to assemble the stacked modules, the ends 26 of mounting pins 24 are preferably deformed plastically by a conventional riveting technique. Thus movement 3 formed from the assembly of modules 32, 33 and 36 is assembled by compression between first and second planes, formed respectively by a face 23 of back cover 22 and by a shoulder 25 of mounting pins 24 formed after ends 26 thereof have been plastically deformed.

As mentioned in the preamble of the present description, without any other mechanisms, the vertical precision of the assembly forming movement 3 of timepiece 1 is dependent upon the precision and manufacturing tolerances of the various stacked elements. In particular, the vertical precision of the assembly is especially dependent upon the precision and manufacturing tolerances of printed circuit board 34, the thickness of the other elements being able to be guaranteed more easily within a reduced tolerance range.

According to the present invention, in order to assure adequate thickness precision of the assembly forming timepiece movement 3, tube-shaped intermediate elements 8, called stepped tubes, are placed on mounting pins 24 in immediate proximity to the element whose thickness is not guaranteed, namely printed circuit board 34. FIG. 3 shows the structure of a stepped tube 8.

This stepped tube 8 includes in particular first and second reference surfaces indicated respectively by the reference numerals 81 and 82. These reference surfaces 81 and 82 are substantially perpendicular to the direction of mounting pins 24 and are separated by a determined distance d1 which is greater than the thickness e of printed circuit board 34. These first and second reference surfaces 81, 82 support the assembly, on the one hand, by resting on lower plate 32, and on the other hand, by resting on the coil core (for example cores 64, 74 of coils 63, 73).

Stepped tube 8 further includes a zone 85, disposed between said reference surfaces 81, 82, arranged to keep printed circuit board 34 in abutment in the assembly. Preferably, this zone 85 penetrates plastically printed circuit board 34. Thus, when assembled on mounting pins 24, zone 85 of the stepped tubes penetrates the printed circuit board 34 until reference surfaces 81 and 82 come into contact with the neighbouring elements, in this case, lower plate 32, on the one hand, and the coil cores, on the other hand. In the end, the thickness e of printed circuit board 34 thus in no way affects the total thickness of the assembly forming movement 3.

In order to do this, it is obviously necessary for the length of zone 85, referenced d2, (in the direction of mounting pins 24) to allow thickness variations in printed circuit board 34 to be absorbed and to be consequently greater than the maximum verifiable thickness of printed circuit board 34. In the illustration of FIG. 3, this distance d2 is taken between a shoulder 83 of stepped tube 8 and the second reference surface 82. It will however be understood that this shoulder 83 is not necessary and that distance d2 may be defined by the distance d1 separating the two reference surfaces 81 and 82.

Zone 85 absorbing the thickness variations in printed circuit board 34 of electronic module 33 may have various forms. Preferably, as illustrated, this zone 85 has a portion 86 of slightly greater diameter than the diameter of assembly orifice 34*a* in which it is inserted. Advantageously, this portion 86 can have a substantially conical shape. Alternatively this portion 86 can have radial projections (star-shaped section) intended to penetrate the walls of assembly orifice 34*a* of printed circuit board 34.

Also, by way of alternative, one may envisage providing stepped tubes 8 with axial projections directed to the surface of printed circuit board 34. With reference to FIG. 3, these axial projections could for example be arranged on shoulder 83 of stepped tube 8.

Generally, it will be understood that the stepped tube essentially fulfils two functions, namely (i) absorbing the thickness variations in an element whose thickness is not guaranteed with any precision (here printed circuit board 34), and (ii) nevertheless keeping this element in abutment in the assembly (in this particular case, keeping printed circuit board 34 abutting against the coil cores of the drive means).

Any shape of stepped tube allowing the two aforementioned functions to be fulfilled may thus be used. These stepped tubes must simply be inserted in an assembly orifice of the element concerned and (i) have first and second reference surfaces 81, 82 separated by a determined distance greater than the thickness of the element concerned and against which the assembly is supported, and (ii) have a zone 85, between these reference surfaces, keeping the element concerned in abutment in the assembly, the length of this zone 85 having to be sufficient to absorb variations in the element's thickness.

As illustrated in FIGS. 2 and 3, stepped tubes may also advantageously be extended axially by a tubular portion 87 co-operating with the assembly orifices of the coil cores (orifices 64*a* and 74*a* in the Figures). In particular, this tubular portion 87 is advantageously driven into the assembly orifices of the coils (orifices 74*a* for example) in order to secure the coils of printed circuit board 34 of electronic module 33.

By means of stepped tubes 8 according to the illustrations of FIGS. 2 and 3, the coils are thus preferably mounted on printed circuit board 34 and secured thereto so as to form a semi-finished module able to be assembled in the timepiece. In particular, the motor coils may be mounted beforehand in printed circuit board 34 of electronic module 33 by means of stepped tubes 8, then connected to the connection pads typically made on printed circuit board 34 of electronic module 33, the latter being then ready for mounting in the timepiece.

Electronic module 33 thus includes not only printed circuit board 34 and the various components such as the quartz, the integrated circuit, the battery connection members, but also a part of the drive means components, namely the coils (in particular coils 63 and 73 illustrated in FIGS. 1 and 2) of the various timepiece motors. Within the scope of the present invention, it might also be noted that electronic module 33 already answers, in itself, the definition of a stacked assembly as claimed.

Within the scope of the particular embodiment illustrated in the Figures, certain points should also be specified. With reference to the illustrations of FIGS. 2 and 3, it should be noted that stepped tubes 8 are in contact, on the one hand, with lower plate 32, and on the other hand with the coils of the motors forming the drive means of the various analogue display members of the timepiece. Very particular care should consequently be paid to the materials used to make the aforementioned elements.

In the case which has just been described, it was mentioned that lower plate 32 is for example made of a metallic material. In the event that a metallic material of high magnetic permeability were used, such as an iron rich metal alloy, the stepped tubes should be made of a material which is not susceptible or is only slightly susceptible to having a magnetic flux, generated by the motor coils, pass through it, i.e. a material having low magnetic permeability, such as brass for example, such material further having the advantage of being sufficiently hard to penetrate printed circuit board 34 plastically. Any other material having acceptable magnetic permeability properties could be used instead of brass. It will be noted that if a material having high magnetic permeability were used, the magnetic flux generated by the motor coils would be susceptible to extending into lower plate 32. It will be understood that one may obviously also envisage making lower plate 32 of a material with low magnetic permeability in order to avoid this drawback.

With respect to the illustrated timepiece forming an advantageous application example of the present invention, the precise vertical assembly obtained as a result of the addition of stepped tubes 8 in immediate proximity to printed circuit board 34 allows a precise thickness to be guaranteed for watch movement 3. In particular, this assembly ensures an adequate clearance to allow the rotation of the wheels of movement 3.

Figure 4:
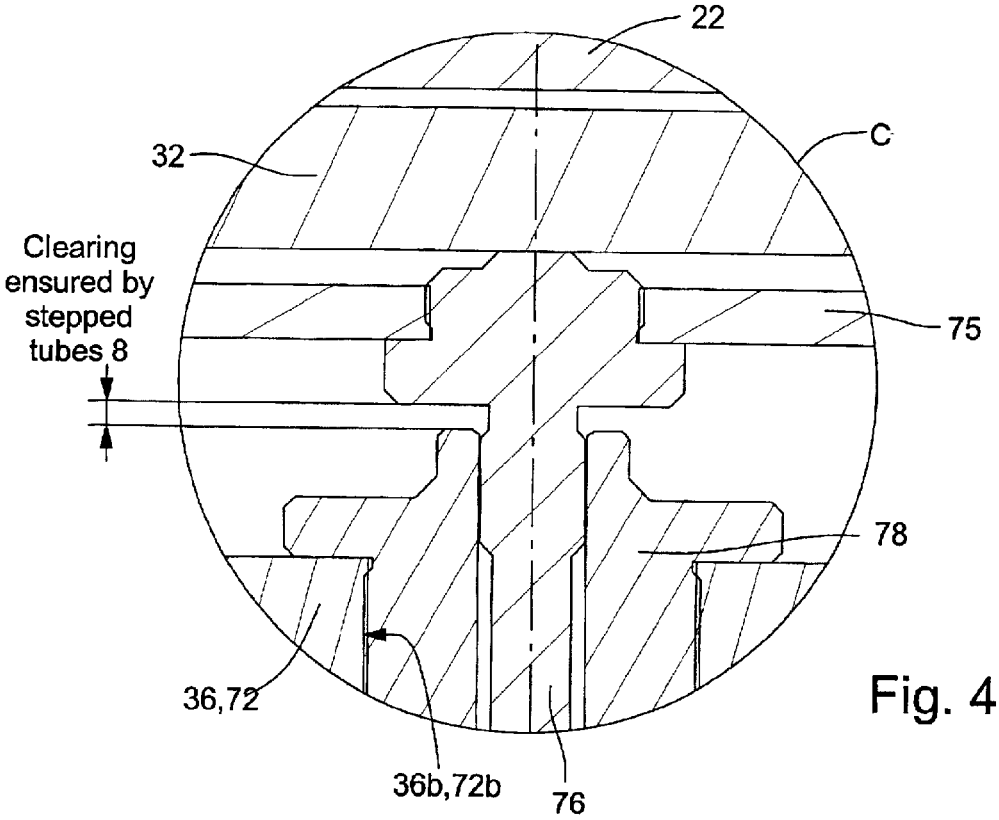
FIG. 4 shows an enlarged cross-section designated C of a wheel of the timepiece illustrated in FIGS. 1 and 2, showing a clearance allowing this wheel to rotate, this clearance being guaranteed by the mode of assembly according to the present invention.

By way of example, FIG. 4 shows an enlarged view, designated C, of the base of counter wheel 75 and the shaft 76 of counter wheel. As illustrated in this Figure and in FIG. 2, the shaft 76 of counter wheel is rotatably mounted in a tubular element 78 which abuts in an orifice 36*b* arranged in motor module 36, or more exactly in orifices arranged respectively in the stator (for example an orifice 72*b* of stator 72) and in upper plate 37. In order to ensure that rotation of the wheel such as counter wheel 75 is possible, it should be ensured that a sufficient clearance exists between this counter wheel 75 and tubular element 78. If such a clearance were not assured, the rotation of counter wheel 75 could be made impossible if the modules were to be assembled so that tubular element 78 gripped counter wheel 75 against lower plate 32.

Thus, the distance d1 between the reference surfaces of stepped tubes 8 is here preferably selected so that it allows (i) precise vertical assembly of the various stacked modules, and (ii) clearance as regards the wheels of the movement, for example as regards counter wheel 75 illustrated in the Figures.

It will be understood that various modifications and/or improvements obvious to those skilled in the art may be made to the embodiments described in the present description without departing from the scope of the invention defined by the annexed claims. In particular, although the assembly was described as being assembled by plastic deformation of the ends of the mounting pins, i.e. in accordance with a riveting technique, the assembly may alternatively be assembled by other equivalent techniques via which the various stacked modules would be held together by compression between two planes, for example by means of a screw fixation system. This use of a riveting technique however proves particularly advantageous economically, in particular with a view to automatize the assembly.

What is claimed is:

1. A stacked assembly of a plurality of modules forming an electronic or electromechanical device, said modules being mounted via assembly orifices on a plurality of mounting pins and assembled by compression between first and second planes, said plurality of modules including at least a first element whose thickness is not guaranteed with great precision, wherein said assembly includes a plurality of tube-shaped intermediate elements, called stepped tubes, mounted respectively on said mounting pins, each stepped tube being inserted in an assembly orifice of said first element, each stepped tube having:

first and second reference surfaces separated by a determined distance greater than the thickness of said first element and against which the assembly is supported, and a zone, between said first and second reference surfaces, allowing said first element to be kept in abutment in the assembly, the length of said zone, in the direction of said mounting pins, being such that it allows variations in the thickness of said first element to be absorbed.

2. An assembly according to claim 1, wherein said zone penetrates said first element so as to plastically deform said first element and has a portion of slightly greater diameter than the diameter of the assembly orifice in which it is inserted.

3. An assembly according to claim 2, wherein said portion is of substantially conical shape.

4. An assembly according to claims 1 to 3, wherein said modules are assembled by plastically deforming the ends of said mounting pins.

5. A timepiece including a case and a stacked assembly of a plurality of modules forming a movement of the timepiece, said modules being mounted in said case via assembly orifices on a plurality of mounting pins and assembled by compression between first and second planes, said plurality of modules including at least a first element whose thickness is not guaranteed with great precision, wherein said assembly includes a plurality of tube-shaped intermediate elements, called stepped tubes, mounted respectively on said mounting pins, each stepped tube being inserted in an assembly orifice of said first element, each stepped tube having:

first and second reference surfaces separated by a determined distance greater than the thickness of said first element and against which the assembly is supported, and a zone, between said first and second reference surfaces, allowing said first element to be kept in abutment in the assembly, the length of said zone, in the direction of said mounting pins, being such that it allows variations in the thickness of said first element to be absorbed.

6. A timepiece according to claim 5, wherein said zone penetrates said first element so as to plastically deform said first element and has a portion of slightly greater diameter than the diameter of the assembly orifice in which it is inserted.

7. A timepiece according to claim 6, wherein said portion is of substantially conical shape.

8. A timepiece according to claim 5, wherein said modules are assembled by plastically deforming the ends of said mounting pins.

9. A timepiece according to claim 5, wherein said timepiece is an electromechanical timepiece and wherein the distance between said first and second reference surfaces is determined so as to assure a clearance allowing wheels of the timepiece movement to rotate.

10. A timepiece according to claim 5, wherein said mounting pins are in a single piece with a back cover of said case.

11. A timepiece according to claim 10, wherein said timepiece is an electromechanical timepiece and wherein said assembly includes a successive stack, on said back cover, of a lower plate, an electronic module including in particular a printed circuit board and forming said first element of non-guaranteed thickness, and a motor module including in particular at least a motor driving analogue display members.

12. A timepiece according to claim 11, wherein a coil of said motor is further assembled by means of said mounting pins between said printed circuit board and a corresponding stator of said motor, said coil being secured to said printed circuit board of the electronic module by means of said stepped tubes.

13. A timepiece according to claim 5, wherein said mounting pins are made of a plastic material.

14. A timepiece according to claim 5, wherein said stepped tubes are made of a material having low magnetic permeability.

15. A timepiece according to claim 14, wherein said material of low magnetic permeability is brass.

* * * * *